US006330733B1

(12) United States Patent
Rauschenberger

(10) Patent No.: US 6,330,733 B1
(45) Date of Patent: Dec. 18, 2001

(54) ARTICULATION, ESPECIALLY FOR CONNECTING SIDEPIECES OF LADDERS

(75) Inventor: Jörg Rauschenberger, Asperg (DE)

(73) Assignee: Rauschenberger GmbH u. Co. (DE)

( * ) Notice: Subject to any disclaimer, the term of this patent is extended or adjusted under 35 U.S.C. 154(b) by 0 days.

(21) Appl. No.: 09/483,514

(22) Filed: Jan. 14, 2000

(30) Foreign Application Priority Data

Jan. 14, 1999 (DE) ..... 199 01 125

(51) Int. Cl.[7] ..... E05D 11/10

(52) U.S. Cl. ..... 16/326; 16/324; 16/332; 403/93

(58) Field of Search ..... 16/326, 329, 332, 16/324; 182/163; 403/92, 93, 95–98

(56) References Cited

U.S. PATENT DOCUMENTS 4,645,371 * 2/1987 Wang ..... 16/332
4,770,559 * 9/1988 Yoo ..... 403/93
4,805,737 * 2/1989 Peng ..... 16/332
4,890,950 * 1/1990 Yoo ..... 16/328
4,925,329 * 5/1990 Chuang ..... 16/332
4,928,792 * 5/1990 Krause ..... 403/93
5,022,118 * 6/1991 Wan-Li ..... 16/327
5,026,198 * 6/1991 Lin ..... 16/324
5,058,239 * 10/1991 Lee ..... 16/324
5,353,892 * 10/1994 Lu ..... 182/163

* cited by examiner

*Primary Examiner*—Chuck Y. Mah
(74) *Attorney, Agent, or Firm*—R. W. Becker & Associates; R. W. Becker

(57) ABSTRACT

A joint or articulation (1), especially for connecting sidepieces of a multi-purpose ladder that can be folded up, has two joint legs (2, 3) that are pivotable relative to one another about a joint shaft (4). One of the joint legs (2) forms an outer joint portion having outer shells (7) and a joint connector (8), while the other joint leg (3) is embodied as an inner joint portion having inner disks (9) and joint connectors (10). A spring-loaded locking member (24) is movable essentially radially or tangentially relative to the joint shaft (4) and is engageable in at least one recessed portion (42) of one joint leg (2). In order to achieve a simpler construction of the joint or articulation (1), recessed portions (12) are provided in the inner disk (9), whereby the locking member (24) extends transverse to the plane of the inner disk through the recessed portions (12). The locking member (24) cooperates with a lever (20) that is pivotable about a journal (19) that is spaced from the joint shaft (4).

11 Claims, 5 Drawing Sheets

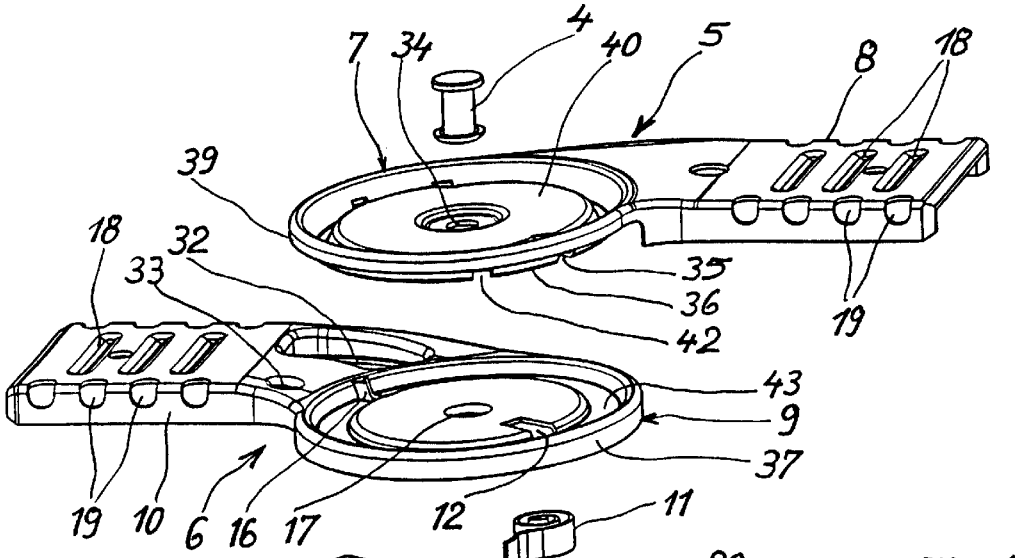
Fig. 1
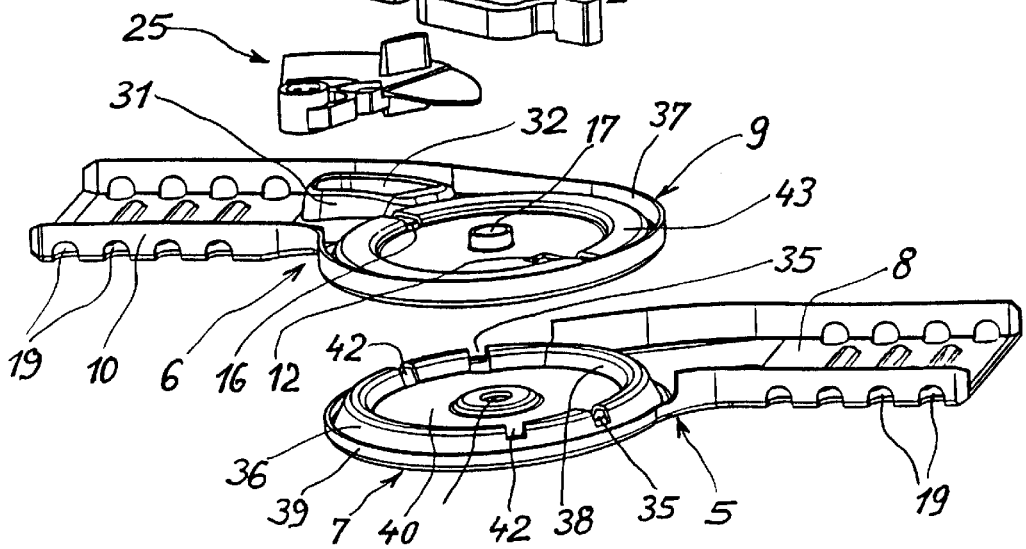
Fig. 2a
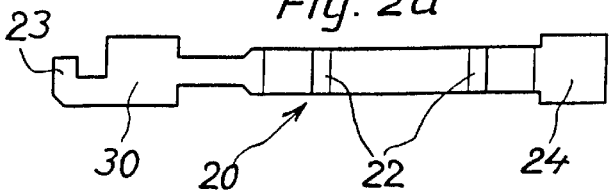
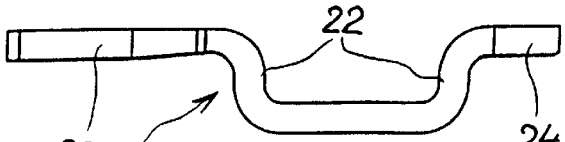
Fig. 2b
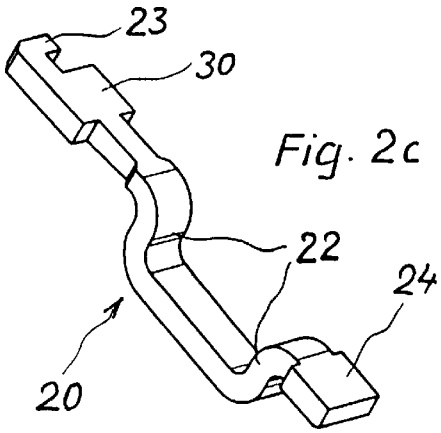
Fig. 2c

ARTICULATION, ESPECIALLY FOR CONNECTING SIDEPIECES OF LADDERS

BACKGROUND OF THE INVENTION

The present invention relates to an articulation or joint, especially for connecting sidepieces of a multi-purpose ladder that can be folded up.

DE 32 11 164 C2 describes a multi-purpose ladder that can be folded together, the sidepieces of which are connected by joints or articulations that are disposed in pairs and can be locked in a number of working positions. Each of these joints has two joint portions that are pivotable about a common joint shaft, whereby one of these joint portions forms a dual-shell locking disk. In the vicinity of its periphery, this locking disk has grooves that are distributed in conformity with the operating positions. Engaging into this grooves is a spring-loaded locking piece that can be raised out of the grooves for the purpose of pivoting the joint portions. This locking piece comprises a locking bar having an essentially rectangular cross-sectional configuration; the height of the locking bar is approximately equal to the width of the second joint portion. The locking piece is guided in a recessed portion in the side walls of the second joint portion, and includes a guide part that adjoins the locking bar, with the height of the guide bar being only slightly less than the height of the second joint portion, whereby the width is greater than the width of the recessed portion. In order to return the locking piece into the locking position, an abutment is provided for the return spring. The locking piece can be raised out of the respective groove of the locking disk by means of a release lever that is pivotably mounted on the second joint portion and is connected with an actuating lever. The release levers of the joints associated with the two sidepieces are interconnected by a rod, so that an unlocking of the locking pieces of the paired joints can be simultaneously activated. The recessed portion has sections of different width, so that a deposition surface is formed in which the locking bar is held in its disengaged position. The locking disk, which is provided with grooves, is provided with projections disposed next to the grooves that serve as abutment surfaces for the locking bar of the locking piece, so that the locking piece is pressed from the deposition surface in the direction of folding-together of the sidepieces, and hence automatically engages in the groove.

It is an object of the present invention to provide a joint or articulation that has a straightforward construction and is economical to produce.

SUMMARY OF THE INVENTION

This object is inventively realized by a joint or articulation having the features: two joint legs that are pivotable relative to one another about a joint shaft, wherein each of the legs comprises a pair of shaped parts, wherein one of the joint legs forms an outer joint portion having outer shells and a joint connector, and the other joint leg is embodied as an inner joint portion having inner disks and joint connectors, and wherein recessed portions are provided in the inner disks; at least one spring-loaded locking member that is movable essentially radially or tangentially relative to the joint shaft, and is engageable in at least one further recessed portion of the one joint leg, wherein the locking member extends transverse to the plane of the inner disks through the recessed portions thereof; and a lever that is pivotable about a journal that is spaced from the joint shaft, wherein the locking member cooperates with the lever.

A number of advantages of the present invention can be seen in that while maintaining all required functions and fulfilling the safety regulations, the joint or articulation comprises an extremely small number of individual parts, and these parts can be manufactured and assembled in a simple manner. Furthermore, the movable elements, such as locking member and lever, as well as the recessed portions required for engagement of the locking member, are disposed in an essentially enclosed region within the outer shell, so that the joint or articulation is well-protected from dirt or contamination. Merely the slots for the locking members are open toward the outside, and a gripping element or activation knob or possibly a rod for activation with one hand at both sides are located as movable elements outside the joint.

Pursuant to one preferred specific embodiment of the basic concept of the present invention, the lever is disposed beyond the contour of the outer shell in a region adjacent to the joint connector between the inner disks, whereby this lever cooperates with one end of a locking slide that carries at least one locking member. In this way, the form of the required parts is further simplified, whereby the locking slide, while comprising a single piece, can also include two locking members that are preferably aligned with one another. In this way, the respective requirements for transmitting forces can be handled not only by the strength of the materials used, but also by the number of locking members. In order to produce an appropriate return force, a spring is preferably provided that is disposed between the inner disks and that acts with one end upon the locking slide. Such a spring is preferably a flat spring or a helical spring, which engages a bent section of the locking slide.

Pursuant to a first modified embodiment, the lever is mounted in the joint connector of the inner joint portion, whereby the pivot axis of the lever extends parallel to the joint shaft. In this connection, it is expedient that the lever includes a cover or guide part that is pivotable between the joint connectors, and at least one actuation element that is carried thereby as well as a journal bushing, whereby the actuating elements project outwardly through an opening in the joint connectors. With such an embodiment, due to the defined spacing of the parts of the joint connector that accommodate the lever between them, and which joint connector corresponds to the thickness of the cover or guide part with appropriate play, a pivoting of the lever that is free of jamming is ensured, and the penetration of dirt is avoided. Between the actuating element and the journal bushing there is provided a cutout in the lever in which the hook of the locking slide is suspended. In this way, a positive connection is provided between the lever and the locking slide.

In another embodiment of the invention, the lever is mounted in a cover secured to the inner joint portion, whereby the pivot axis of the lever extends perpendicular to the joint shaft. In this connection, a pressure or thrust plate that acts upon the lever is provided in the cover; the thrust plate is fixedly connected with a pin that is rotatably journaled in the joint shaft. This thrust plate serves for the unlocking of the joint, whereby the lever converts the movement of the thrust plate into a movement of the locking slide that extends transverse thereto.

In order during unfolding of the sidepieces of the ladder for the locking member to automatically engage or register in the recessed portions, a spring is expediently provided that interacts with the locking slide and biases the latter in the locking direction. The spring can, for example, be a flat or helical spring that is held by one end on the inner disk.

Since for unlocking or locking the locking member is moved essentially radially relative to the joint shaft, the recessed portions in the inner disks also extend essentially radially. In each inner disk such recessed portions include a narrow section as well as a wider section that is disposed closer to the joint shaft, as well as a shoulder that is disposed between the two sections and against which the locking member can be supported. This shoulder serves for holding the locking member in the unlocked position, so that during folding together of the sidepieces of the ladder, the joint portions can be pivoted without the locking members engaging in intermediate recesses. So that this position of the locking member is maintained while the sidepieces of the ladder are folded together, yet is released in the opposite pivoting direction, it is advantageous to provide on glide surfaces, next to each recessed portion in the outer shell, a raised portion that is directed radially relative to the joint shaft, whereby in the direction of folding together of the joint connectors this raised portion has the shape of a ramp, and in the opposite direction has a steeply rising flank. This steeply rising flank acts as an abutment for the locking member, so that the latter is pressed away from the shoulder and hence can penetrate into the recessed portion in the outer shell. To the extent that the locking members of two joints or articulations on opposite sidepieces of a ladder are to be actuated together, a rod or handle that extends between the joints is provided. In this connection, it is advantageous to mount the ends of the rod in a mounting opening of each of the two joints formed on the inner joint portions thereof. The rod can be operatively connected directly with the actuating elements.

BRIEF DESCRIPTION OF THE DRAWINGS

Specific embodiments of the invention will be described in greater detail subsequently with the aid of the drawings, in which FIG. 1 is an exploded view of a joint or articulation, FIGS. 2*a* to 2*c* show three different views of a locking slide, FIG. 4 is an inner view of the joint or articulation with inner and outer joint portions and installed lever and locking slide in the locked state of the joint in the extended position.

DESCRIPTION OF PREFERRED EMBODIMENTS

Figure 5:
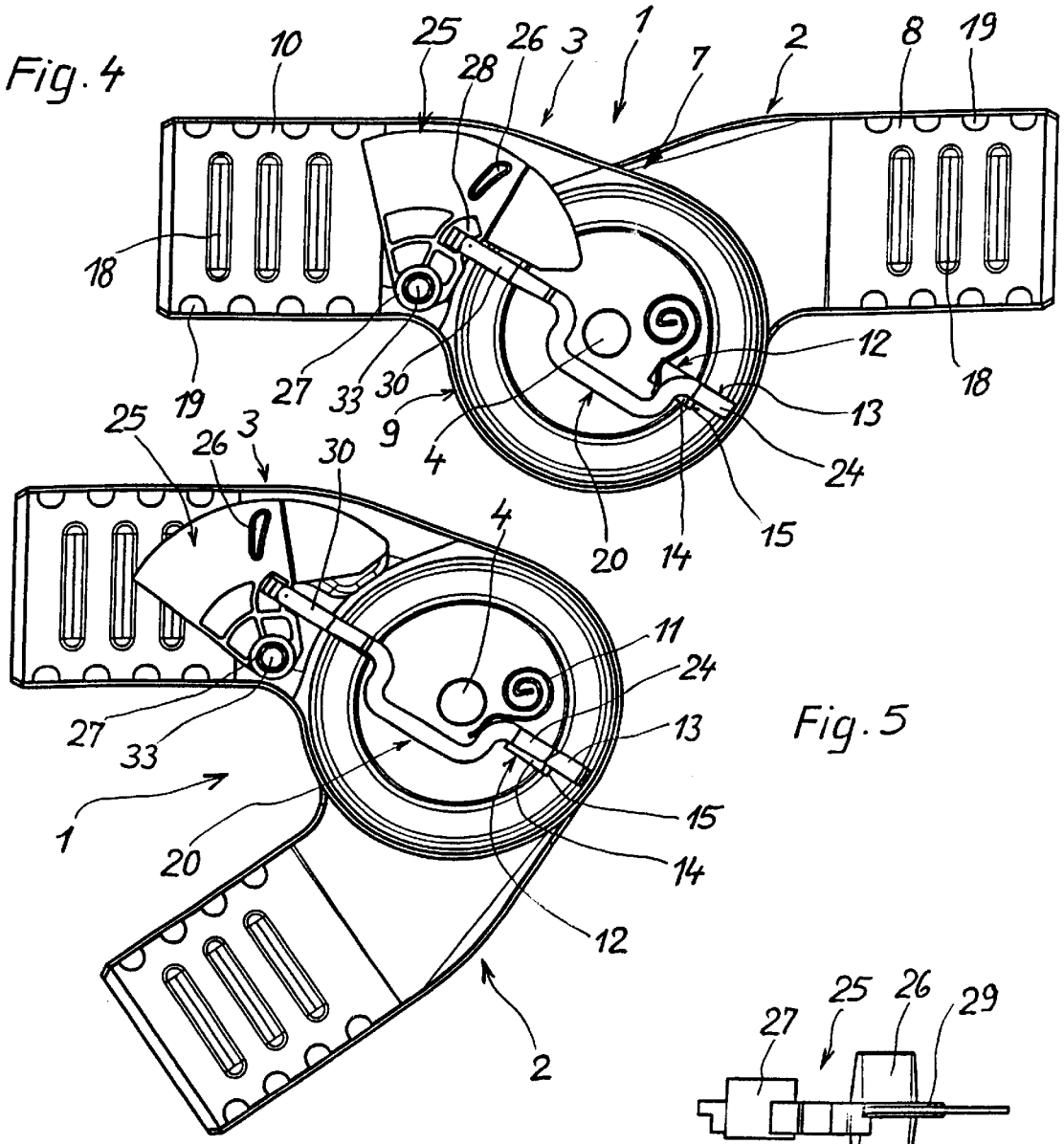
FIG. 5 is a view according to FIG. 4 in the unlocked position and a position of the joint connectors in which they form a relatively acute angle.

The joint or articulation illustrated in the exploded view of FIG. 1 comprises an outer portion 5 and an inner portion 6, whereby the outer portion 5 of the articulation or joint is formed from two outer shells 7 having joint connectors 8 and the inner portion 6 of the articulation or joint is formed from two inner disks 9 having joint connectors 10. In an inwardly directed curvature, the outer shells 7 are provided with a central opening 34, and the inner disks 9 are provided with a central opening 17 that is surrounded by a support; the openings are lined with one another and an articulation shaft 4 in the form of a bolt or rivet is guided through the openings. The outer joint portion 5 and the inner joint portion 6 are pivotable relative to one another about the articulation or joint shaft 4. To increase the shape rigidity, the joint connectors 8 and 10 are provided with reinforcing creases 18, and for the connection with a sidepiece of a ladder or the like are provided with openings 19.

The outer shells 7 with the joint connectors 8 are mirror images of one another; the same is true for the inner disks 9 with the joint connectors 10. The inner disks 9 are provided with a raised rim 37 along their periphery, so that a hollow space is formed between the two joined-together inner disks 9. Disposed in this hollow space is a locking slide 20 that is shown in three views in FIGS. 2*a* to 2*c*. As shown in FIGS. 2*a* to 2*c*, the locking slide 20 is formed in one piece from a flat material, and includes two locking members 24 and 30. Disposed between the locking members 24 and 30 are two bent sections 22. On that end of the locking slide 20 disposed at the far side of the locking member 30 is a hook 23 that serves for the positive connection of the locking slide with a lever 25.

Figure 3B:
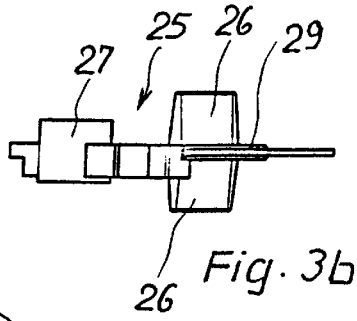
FIGS. 3*a* to 3*c* show three different views of a lever.
Figure 3A:
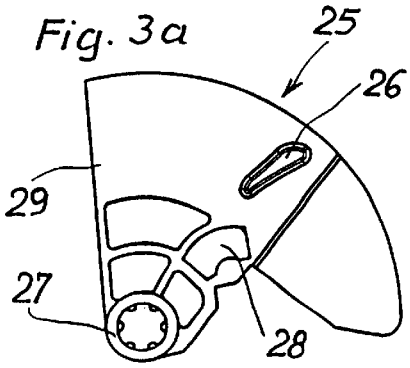
Figure 3C:
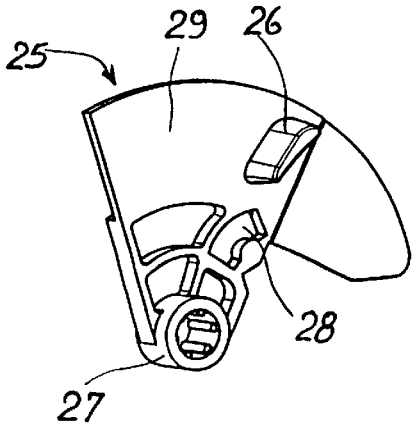

As can be seen from FIGS. 3*a* to 3*c*, the lever 25 includes a journal bushing 27 that is placed upon a journal pin 33 (FIG. 1) that is formed on the inner joint portion 6 by the deformation of material, and also includes a cover or guide part 29 that has the shape of a flat plate. Provided on the cover or guide part 29 is a cutout 28 for hooking in the hook 23 of the locking slide 20. Also disposed on both flat sides of the guide part 29 are actuating elements 26 that project essentially at right angles out of the plane of the plate and have such a height that, as shown in FIG. 1, they extend all the way to the outside through openings 32 that are formed in supports 31 of the joint connector 10.

To guide the locking slide 20 in the inner joint portion 6, there is formed on the inner disks 9 a ring 43 that extends parallel to the rim 37 and in which recessed portions 12 and 16 are disposed that extend approximately radially relative to the rotation shaft 4. A spring 11 is placed in the hollow space formed between the inner disks 9; the spring acts upon the locking slide 20 in a locking direction.

The outer shells 7 comprise a cover portion 40 and a circumferential rim 39, and radially spaced therefrom a ring 36 directed toward the inner disks 9 is provided in which are disposed recessed portions 35, 42 that form radial slots. The locking members 24 and 30 can engage these recessed portions 35 and 42, or, for unlocking purposes, can also be pressed out of these recessed portions. Instead of the ring 36, ring segments having appropriate gaps can also be provided, whereby the gaps, which serve for receiving the locking members 24, 30, have a comparable shape and size to the recessed portions 35, 42. Formed on the radially inwardly disposed side of the rings 36, which are shaped similar to arcs of a circle, is a glide surface 38 for the locking members 24 during pivoting of the joint parts.

FIG. 4 shows a joint or articulation 1 that comprises two legs 2 and 3. The legs 2 and 3 of the joint or articulation include joint connectors 8 and 10 that are provided for being received in sidepieces of a ladder. The two joint legs 2 and 3 have a common joint axis or shaft 4, and are pivotable relative to one another about this shaft. In FIG. 4, the outer shell 7 is shown covered, whereas the inner disk 9 of the joint leg 3 is visible. In addition, it can be seen that the spring 11 of the locking slide 20 is biased on one of its bent sections 22, and in particular in a direction in which the locking member 24 is pressed into a narrow section 13 of the recessed portion 12. The locking member 30 is disposed in the recessed portion 16. The recessed portion 12 also includes a wider section 14 that is disposed further radially inwardly, as well as a shoulder 15 that is provided between the sections 13 and 14. In this position of the locking slide 20, the lever 25 is disposed in its end position toward the joint shaft 4. In FIG. 4 the position of the journal pin 33 upon which the journal bushing 27 is placed is also visible. In other respects, the reference numerals for the same parts correspond with those of FIG. 1.

Whereas FIG. 4 illustrates the joint or articulation 1 in the locked position in the extended position of the joint connectors 8, 10, FIG. 5 illustrates the arrangement in the unlocked position, whereby the joint connectors 8 and 10 are pivoted toward one another and form an angle between them of about 30°. In this position, the locking slide 20 is pressed transverse to the joint shaft 4, whereby the locking member 24 is moved toward the joint shaft 4, and the locking member 30 is moved away from the joint shaft 4. The locking slide 20 assumes this position when the lever 25 is pivoted in a counterclockwise direction about the journal pin 33, which is effected with the aid of the actuating element 26 that projects out of the joint connector. If the locking member 24 is pressed entirely out of the narrow section 13 of the recessed portion 12 into the wider section 14, the spring 11, due to its force direction with which it acts upon the bent section 22, moves the locking member 24 approximately in the circumferential direction of the joint 1, so that the front edge of the locking member 24 comes to rest behind the shoulder 15. In other respects, the reference numerals in FIG. 4 correspond for the same parts with those of the previously described figures.

Figure 6:
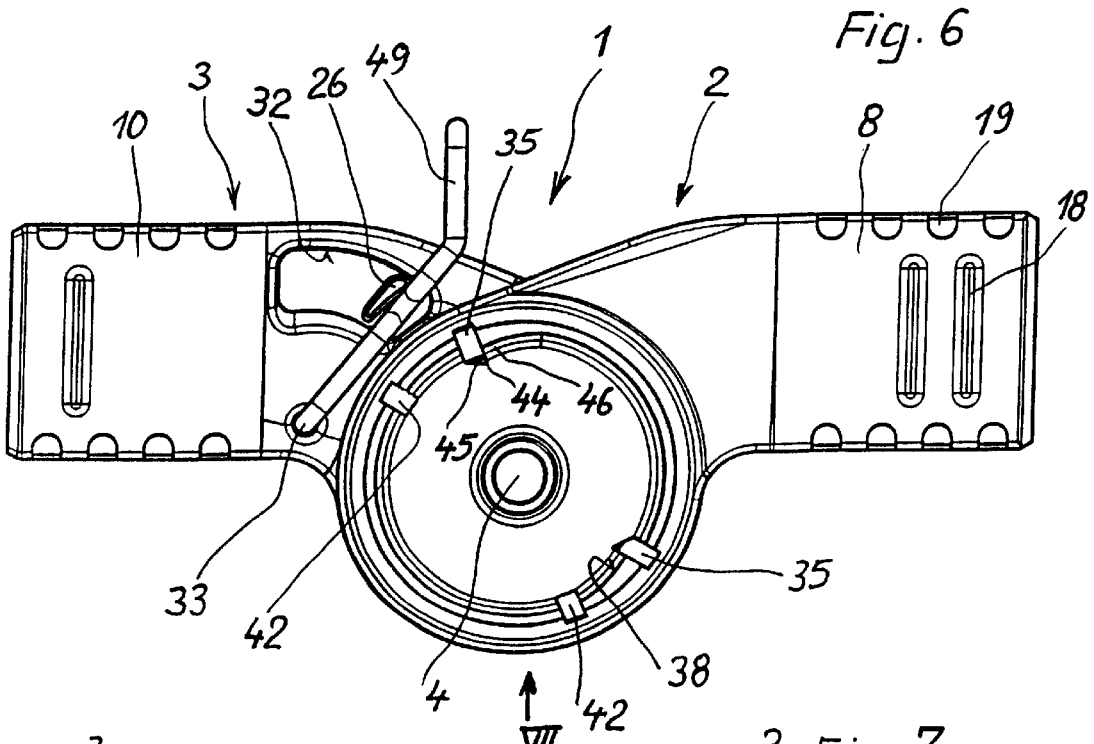
FIG. 6 is an outer view of the joint according to FIG. 4 showing a rod for actuating the lever.

From the outer view of the joint or articulation 1 shown in FIG. 6, the position of the recessed portions 35 and 42 for the engagement of the locking members of the locking slide becomes clear. In this connection, 35 designates those recessed portions in which the locking member 24 illustrated in FIGS. 4 and 5 engages, and 42 designates those recessed portions that are provided for the locking member 30. Since the joint parts 5 and 6 illustrated in FIGS. 1, 4 and 5 are shaped sheet metal parts, the inner contours of the outer shell 7 are recognizable in FIG. 6. Thus, it can be seen that the glide surface 38, next to the recessed portions 35, has a raised portion 44 that is directed radially toward the joint shaft 4 and that on one side is in the form of a shallowly rising ramp 45 and on the other side is formed as a steeply rising flank 46. This steeply rising flank 46 extends at least nearly parallel to the radial direction, relative to the central opening 34 in the outer shell 7.

If the joint or articulation was folded completely together, and if then the joint connectors 8 and 9 are again pivoted relative to one another, then upon reaching a first locking position, which can, for example, be achieved at an angle as shown in FIG. 5, the locking member 24 comes against the flank 46 of the raised portion 44, so that the locking member 24 is pressed within the wide section 14 of the recessed portion 12 in such a way that the locking member locking 24 rests against the shoulder 15. Due to the force of the spring 11, the locking slide 20 is shifted, so that the locking member 24 is moved into the recessed portion 35 and the locking member 30 is moved into the recessed portion 42. In this way, when the joint legs 2, 3 are pivoted apart, there is effected an automatic engagement of the locking members. FIG. 6 also shows a handle or rod 49 that interacts with the actuating element 26, with this rod 49 being provided to facilitate actuation for pivoting of the lever 25. The rod 49 can engage in the journal pin 33 if such journal pin 33 is hollow, for example by deformation of the sheet metal. Instead of the rod 49, in order to be able to activate two joints or articulations with one hand, which joints are disposed in pairs on opposite sides on the sidepieces of a multipurpose ladder, suitable handles or rods are provided.

Figure 7:
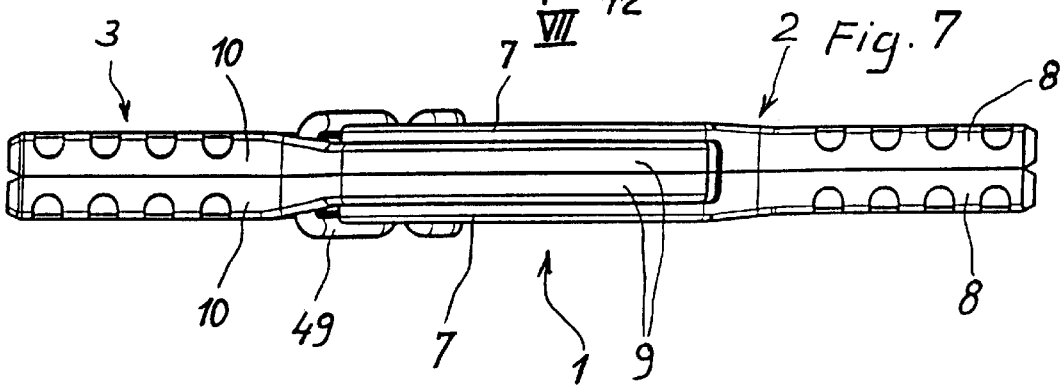
FIG. 7 is a view of the joint in accordance with the arrow VII in FIG. 6.

FIG. 7 is a view of the joint or articulation 1 taken in the direction of the arrow VII of FIG. 6. It can be seen that two outer shells 7 form the outer joint portion 5, and two inner disks 9 form the inner joint portion 6. In other respects, the reference numerals in FIG. 7 correspond for the same parts with those of the previously described figures.

Figure 9A:
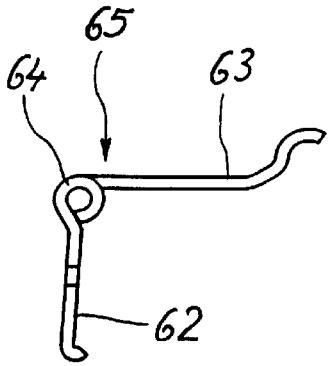
FIGS. 9*a* to 9*b* show two different views of a lever.
Figure 9B:
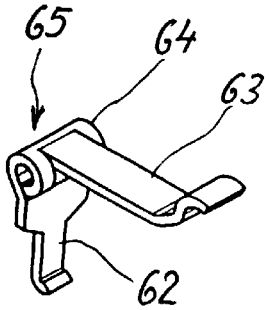
Figure 8:
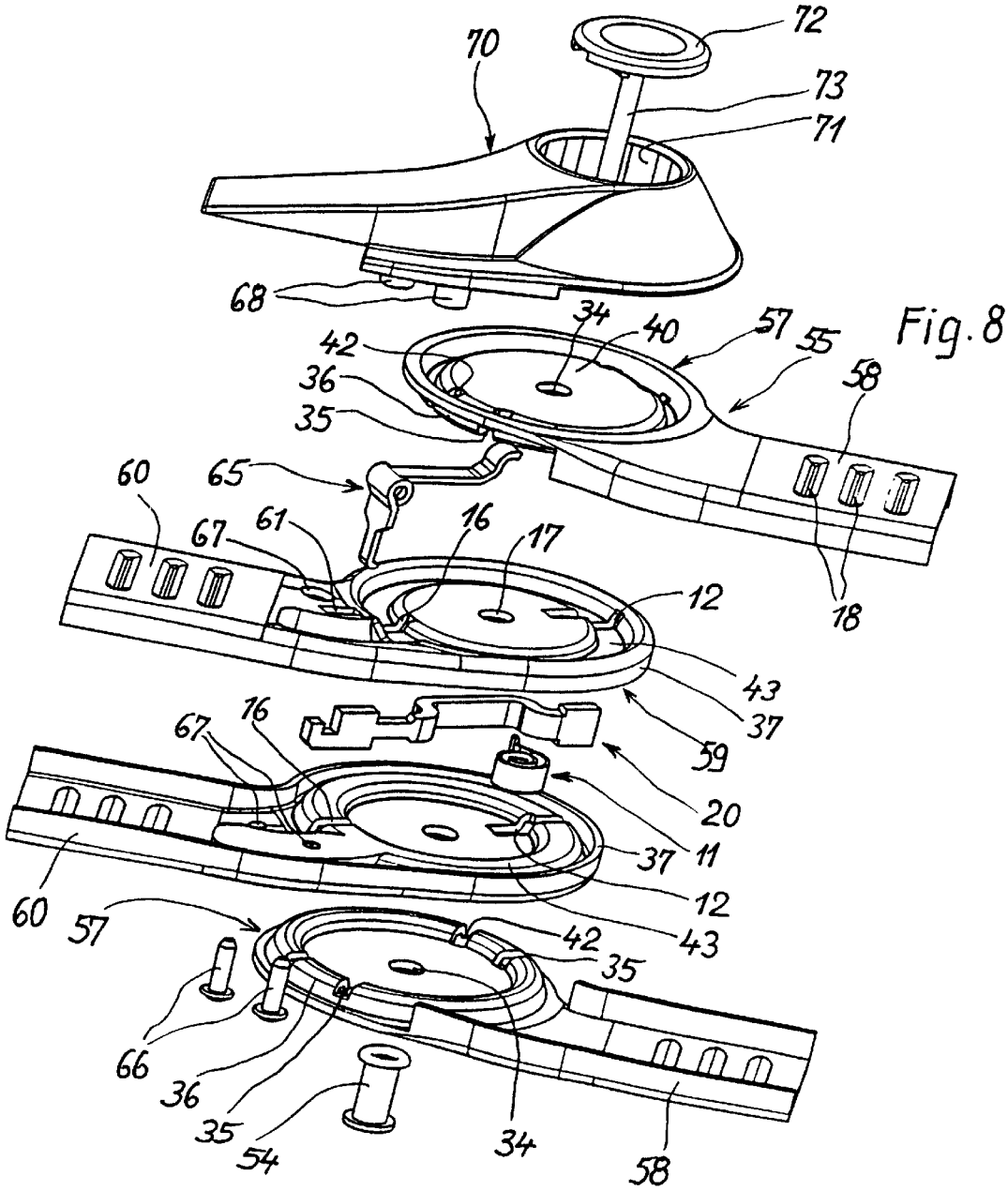
FIG. 8 is an exploded view of a second exemplary embodiment of an inventive joint or articulation.

FIG. 8 is an exploded view of a second exemplary embodiment of the inventive joint or articulation. This joint or articulation 51 includes an outer portion 55 and an inner portion 56. The outer portion 55 of the joint or articulation is formed from two outer shells 57 having joint connectors 58 adjoining thereon, with the configuration thereof being nearly identical to that of the outer shells 7 of FIG. 1. The joint connectors 58 merely have no openings, but rather only reinforcing creases. The locking slide 20 and the spring 11 are identical to those of the embodiment of FIGS. 1 and 2*a* to 2*c*. The guidance of the locking slide 20 is also effected in the inner joint portion 56 in the same manner as with the joint portion in FIG. 1. The inner joint portion 56 is formed of two inner disks 59, whereby in FIG. 8 the upper inner disk, i.e. a joint connector 60 adjoining thereon, is provided with a cutout 61. An arm 62 of a lever 65, which is shown in greater detail in FIGS. 9*a* and 9*b*, projects through this cutout 61. As can be seen, the lever 65 includes two arms 62 and 63, each of which proceeds from a journal bushing 64 and essentially form an angle of about 9°.

The arm 62 serves for engaging in a recessed portion 74, (FIGS. 11 and 12) between the hook 23 and the locking member 30. The outer shells 57 also have central openings 34, and the inner disks 59 have central openings 17, through which a hollow rivet is guided as the joint shaft 54. In addition, two screws or bolts 66 are provided that are inserted through screw holes 67 in the joint connector 60 in order to be screwed into threaded sleeves 68 on a cover 70. This cover 70 covers the upper outer shell 57 and extends over a considerable portion of the joint connector 60. The cover 70 has a bore 71 that serves for receiving a pressure or thrust plate 72 that is displaceable in the bore 71. Disposed coaxially on the thrust plate 72 is a pin 73 that is guided in the hollow rivet that serves as the joint shaft 54.

Figure 10:
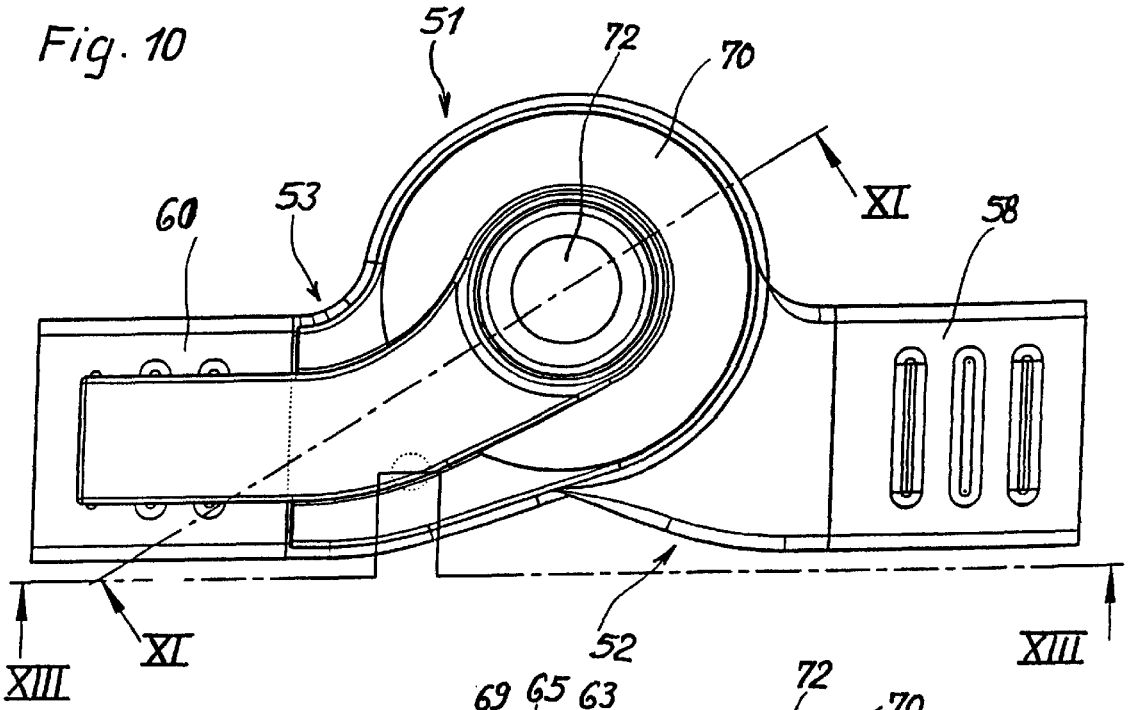
FIG. 10 shows an outer view of the joint or articulation according to FIG. 8.

FIG. 10 shows a plan view on the joint or articulation 51, which is comprised of two joint legs 52 and 53. From this illustration the shape and extension of the cover 70 is recognizable, whereby the thrust plate 72 is disposed centrally relative to the essentially circular portion of the cover 70.

Figure 11:
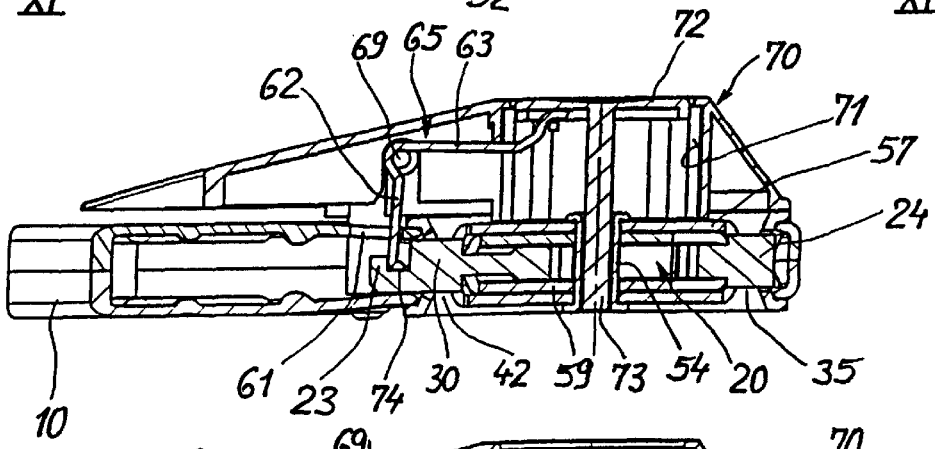
FIG. 11 is a cross-sectional view taken along the line XI—XI in FIG. 10 in the locked state.

FIG. 11 shows a cross-sectional view taken along the line XI—XI in FIG. 10. From this, it can be seen that the journal bushing 64 of the lever 65 is mounted on a pin 69 in the cover 70. The arm 63 of the lever 65 engages under this thrust plate 72, whereas the arm 62 projects through the cutout 61 and engages in the recessed portion formed between the hook 23 and the locking member 30. The locking member 30 is disposed in the recessed portion 42, and the locking member 24 is disposed in the recessed portion 35; in other words, FIG. 11 shows the locked position. In this position, the thrust plate 72 assumes its upper end position, and the pin 73 is at least nearly flush with the underside of the joint or articulation 51.

Figure 12:
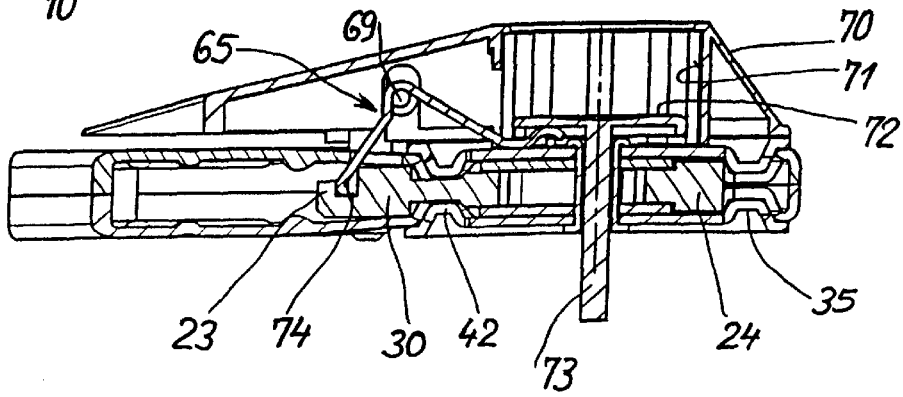
FIG. 12 is a view according to FIG. 11 in the unlocked state.

To unlock the joint or articulation 51, the thrust plate 72 is pressed into the bore 71 of the cover 70, as illustrated in FIG. 12. In so doing, the lever 65 with its two arms 62 and 63 is pivoted, as a result of which the locking slide 20 is shifted to the left in FIG. 12, so that the locking members 24 and 30 come out of engagement with the recessed portions 35 and 42. In this position, the pin 73 projects clearly out of the outer joint portion 55, so that it is easily recognizable from the outside that the joint or articulation 51 is in the unlocked position. The resetting of the locking slide 20 is effected in the same way as with the arrangement of FIGS. 1 to 7 by means of the spring 11 shown in FIG. 8.

Figure 13:
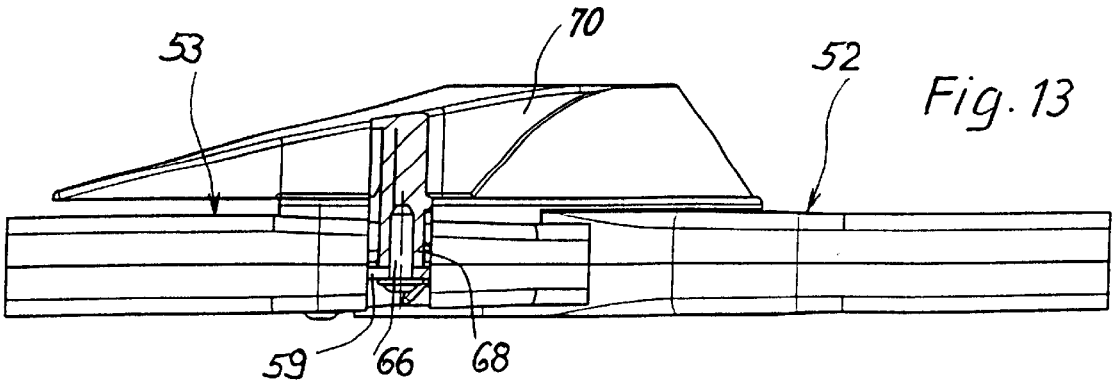
FIG. 13 is a view according to the line XIII—XIII in FIG. 10.

FIG. 13 shows a view taken along the line XIII—XIII, in FIG. 10 whereby this is essentially an outer view and merely a cross-section through the fastening arrangement of the cover 70 on the joint or articulation 51. From this it can been that the screws 71 are inserted from below through the screw holes 67 and are rotated into the threaded sleeves 68 that are formed on the cover 70.

The specification incorporates by reference the disclosure of German priority document 199 01 125.7 of Jan. 14, 1999.

The present invention is, of course, in no way restricted to the specific disclosure of the specification and drawings, but also encompasses any modifications within the scope of the appended claims.

What is claimed is:

1. An articulation comprising:

two joint legs that are pivotable relative to one another about a joint shaft, wherein each of said joint legs comprises a pair of shaped parts, wherein one of said joint legs forms an outer joint portion having outer shells and at least one joint connector, and the other joint leg forms an inner joint portion having inner disks and at least one joint connector, said inner disks having at least one first recessed portion;

a locking slide having at least one spring-loaded locking member, said at least one locking member movable essentially radially or tangentially relative to the joint shaft, and engageable in at least one second recessed portion of said one joint leg, wherein said at least one locking member extends transverse to a plane of said inner disks through said at least one first recessed portion of said-inner disks; and a lever that is pivotable about a journal that is spaced from said joint shaft, wherein said locking slide cooperates with said lever.

2. An articulation according to claim 1, wherein at least one of said at least one second recessed portion is disposed in said outer shells in such a way that said at least one locking member is shiftable out of said at least one second recessed portion in a direction toward said joint shaft.

3. An articulation according to claim 1, wherein said lever is mounted in said at least one joint connector of said inner joint portion, and wherein said journal extends parallel to said joint shaft.

4. An articulation according to claim 3, wherein said lever includes a guide part that is pivotable between said at least one joint connector of said inner joint portions, wherein said lever also includes a journal bushing and at least one actuating element that is carried by said guide part, and wherein said at least one actuating element projects outwardly through an opening in said at least one joint connector of said inner joint portion.

5. An articulation according to claim 1, wherein said lever is mounted in a cover that is secured to said at least one joint connector of said inner joint portion, wherein said journal extends perpendicular to said joint shaft.

6. An articulation according to claim 5, wherein a thrust plate that acts upon said lever is provided in said cover, wherein said thrust plate is fixedly connected to said cover with a pin rotatably journaled in said joint shaft, and wherein, when said articulation is in a locked position, said pin is disposed within a contour of said articulation, and wherein, when said articulation is in an unlocked position, said pin projects clearly and visibly out of said articulation.

7. An articulation according to claim 1, wherein a spring is disposed between said inner disks, and wherein said spring is held on said inner disks and acts upon said locking slide.

8. An articulation according to claim 7, wherein said locking slide comprises two of said at least one locking member that are aligned with one another.

9. An articulation according to claim 1, wherein a respective recessed portion is disposed in each of said inner disks that extends essentially in a radial direction, said recessed portion having a first section and a second section, wherein said second section is wider than said first section, and wherein a shoulder is disposed between said first section and said second section.

10. An articulation according to claim 1, wherein each of said shells is provided with a circumferential rim that is directed toward said inner disks, and wherein either ring segments or a ring is disposed radially spaced relative to said rim, wherein said ring segments have gaps and wherein said ring is directed toward said inner disks and has said at least one second recessed portion, and wherein said recessed portions or gaps serve for receiving said at least one locking member.

11. An articulation according to claim 10, wherein glide surfaces are formed on radially inner sides of said ring, wherein adjacent to said at least one first recessed portion in said shell a raised portion is disposed that is directed radially relative to said joint shaft, and wherein said raised portion, in a direction of folding apart of said joint connectors, has a steeply rising flank, and in the opposite direction has the shape of a ramp.

* * * * *